US010859231B2

(12) United States Patent
Hong

(10) Patent No.: US 10,859,231 B2
(45) Date of Patent: Dec. 8, 2020

(54) LAMP DEVICE FOR VEHICLE

(71) Applicants: Hyundai Motor Company, Seoul (KR); Kia Motors Corporation, Seoul (KR)

(72) Inventor: Seung-Pyo Hong, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/202,592

(22) Filed: Nov. 28, 2018

(65) Prior Publication Data

US 2019/0195462 A1 Jun. 27, 2019

(30) Foreign Application Priority Data

Dec. 22, 2017 (KR) ..... 10-2017-0177964

(51) Int. Cl.

| | |
|---|---|
| ***F21S 45/30*** | (2018.01) |
| ***F21S 43/20*** | (2018.01) |
| ***F21S 45/10*** | (2018.01) |
| ***F21S 43/30*** | (2018.01) |
| ***F21S 43/50*** | (2018.01) |
| ***F21S 43/10*** | (2018.01) |
| ***F21S 45/60*** | (2018.01) |
| ***F21S 43/33*** | (2018.01) |
| ***F21S 43/40*** | (2018.01) |
| ***F21S 41/37*** | (2018.01) |
| ***F21S 41/20*** | (2018.01) |
| ***F21S 41/33*** | (2018.01) |

(52) U.S. Cl.

CPC ..... *F21S 45/30* (2018.01); *F21S 41/20* (2018.01); *F21S 41/337* (2018.01); *F21S 41/37* (2018.01); *F21S 43/10* (2018.01); *F21S 43/255* (2018.01); *F21S 43/26* (2018.01); *F21S 43/30* (2018.01); *F21S 43/33* (2018.01); *F21S 43/40* (2018.01); *F21S 43/50* (2018.01); *F21S 45/10* (2018.01); *F21S 45/60* (2018.01)

(58) Field of Classification Search

CPC . F21V 5/04; F21V 17/06; F21V 19/02; F21V 5/00; F21V 5/008

USPC ..... 362/456

See application file for complete search history.

(56) References Cited

U.S. PATENT DOCUMENTS 5,791,772 A * 8/1998 Rickfelder ..... F21V 5/045 362/488

2006/0291232 A1* 12/2006 Reading ..... F21S 43/51 362/521

FOREIGN PATENT DOCUMENTS

KR 10-1717270 B1 3/2017

* cited by examiner

*Primary Examiner* — William J Carter

(74) *Attorney, Agent, or Firm* — Mintz Levin Cohn Ferris Glovsky and Popeo, P.C.; Peter F. Corless

(57) ABSTRACT

A lamp device for a vehicle is provided. The lamp device includes a light source, a lamp housing that accommodates the light source thereon. A lens is coupled to the lamp housing to allow light emitted from the light source to penetrate the lens and a bezel is coupled to the lamp housing and is disposed between the lens and the light source. In particular, the bezel has a surface structure formed on a rear surface thereof and is configured to reflect irradiated light. The bezel is formed in a color that is complementary to a color of the lens.

5 Claims, 10 Drawing Sheets

LAMP DEVICE FOR VEHICLE

CROSS-REFERENCE TO RELATED APPLICATIONS

This application claims priority to Korean Patent Application No. 10-2017-0177964, filed on Dec. 22, 2017, which is incorporated herein by reference in its entirety.

BACKGROUND

Field of the Disclosure

The present disclosure relates to a lamp device mounted in a vehicle, and more particularly to a lamp device that improves a moisture removal performance and enhances an external appearance.

Description of Related Art

Generally, head lights, reverse lights, fog lamps, tail lamps, turn signal lamps, and the like are mounted on a vehicle for various purposes. In a lamp device for a vehicle in the related art, as shown in FIG. 1, a bulb 5 provided as a light source is mounted in a housing 1, and an outer lens 2 and an inner lens 3 configured to transmit light emitted from the bulb 5 to the outside are coupled to the housing 1. In addition, a bezel 4 is formed at a portion other than a portion at which the light emitted from the light source is irradiated, and FIG. 1 shows that the bezel 4 is coupled between the inner lens 3 and the housing 1.

However, when penetrating the complementary colored (blue colored or blue green colored) bezel, all light is directed towards the outer lens 2 and penetrates the bezel, to allow the light to be used merely for moisture removal effect for the outer lens 2. In addition, when a substantial amount of light emitted from the bulb 5 is irradiated towards the bezel 4, a portion of filament is visible through pores of nanometer (nm) size formed in the bezel.

The contents described in this section are to help the understanding of the background of the present disclosure, and may include information that does not form a prior art known to those skilled in the art to which the present disclosure pertains.

SUMMARY

The present disclosure provides a lamp device for a vehicle which may adjust an irradiation direction of light irradiated to a bezel to improve a moisture removal effect and an external appearance.

A lamp device for a vehicle according to one aspect of the present disclosure may include a light source; a lamp housing that accommodates the light source thereon; a lens coupled to the lamp housing to allow light emitted from the light source to penetrate the lens; and a bezel coupled to the lamp housing, and disposed between the lens and the light source. In particular, the bezel may include a surface structure formed on a rear surface thereof and configured to reflect irradiated light to desired directions. The bezel may have a color which is a complementary color of a lens color.

In addition, the rear surface of the bezel may be formed to have a rear reflector shape by which irradiated light is reflected rearward. Furthermore, the lamp device for a vehicle of the present disclosure may further include a reflecting plate coupled to the lamp housing and disposed behind the light source. Alternatively, the rear surface of the bezel may be formed to have a multi focus reflector surface by which irradiated light is reflected at a reflection angle equal to an incident angle. The lamp device for a vehicle of the present disclosure may further include an additional light source disposed between the bezel and the lamp housing.

BRIEF DESCRIPTION OF THE DRAWINGS

A brief description of each drawing is provided to more sufficiently understand drawings used in the detailed description of the present disclosure.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

In order to fully understand the present disclosure, operational advantages of the present disclosure, objects achieved by exemplary embodiments of the present disclosure, reference should be made to the accompanying drawings and contents illustrated in the accompanying drawings which illustrate exemplary embodiments of the present disclosure. In describing the exemplary embodiments of the present disclosure, well-known techniques or repetitive descriptions that may unnecessarily obscure the gist of the present disclosure will be reduced or omitted.

Figure 1:
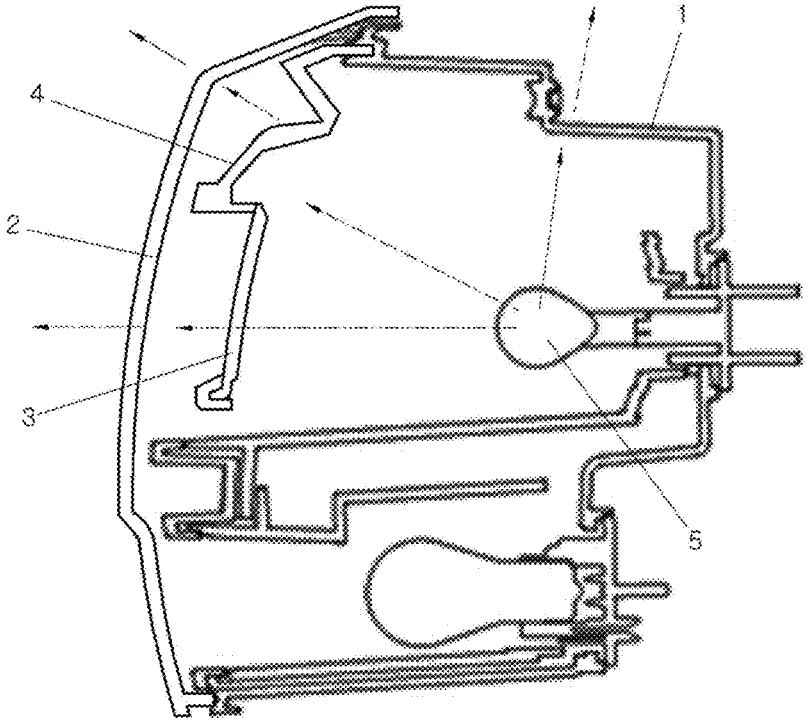
FIG. 1 Related Art
FIG. 1 illustrates a lamp device of the related art.
Figure 2:
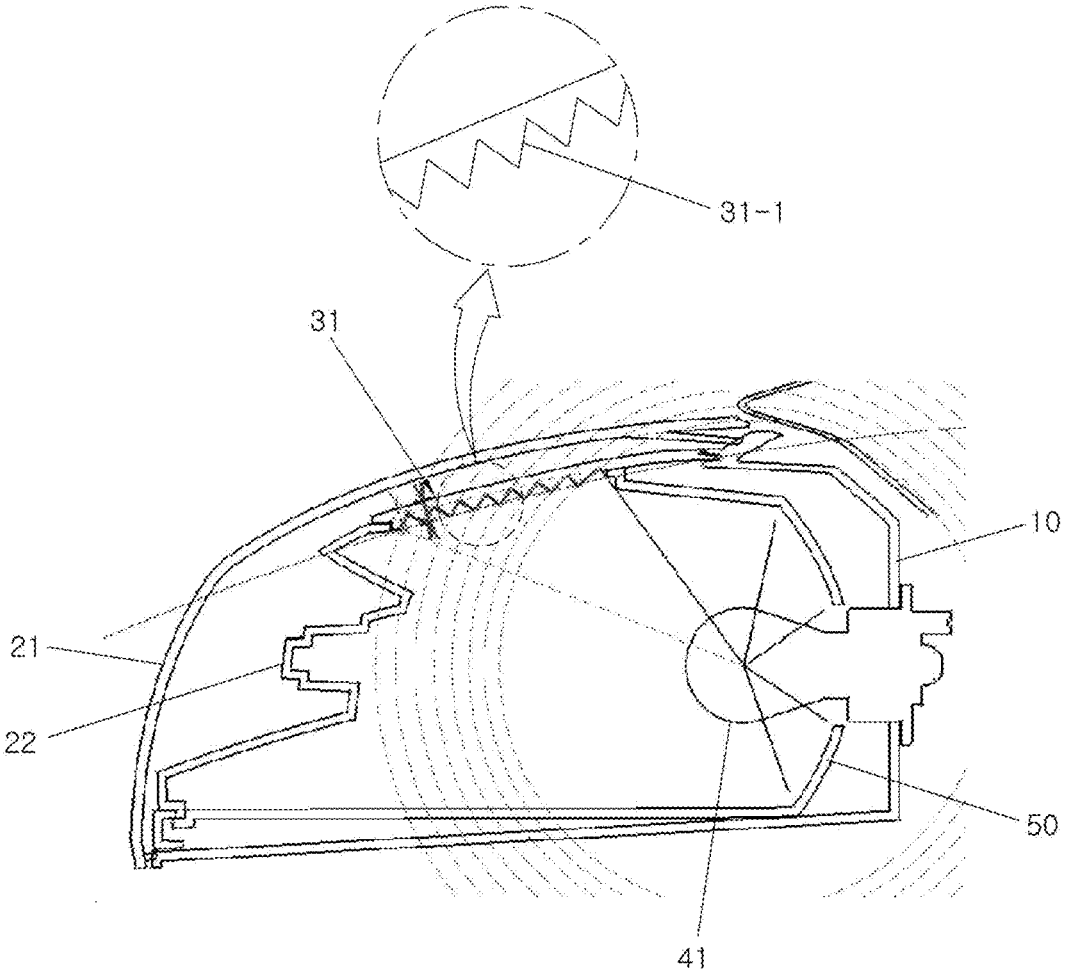
FIG. 2 schematically illustrates a lamp device for a vehicle according to an exemplary embodiment of the present disclosure.
Figure 3:
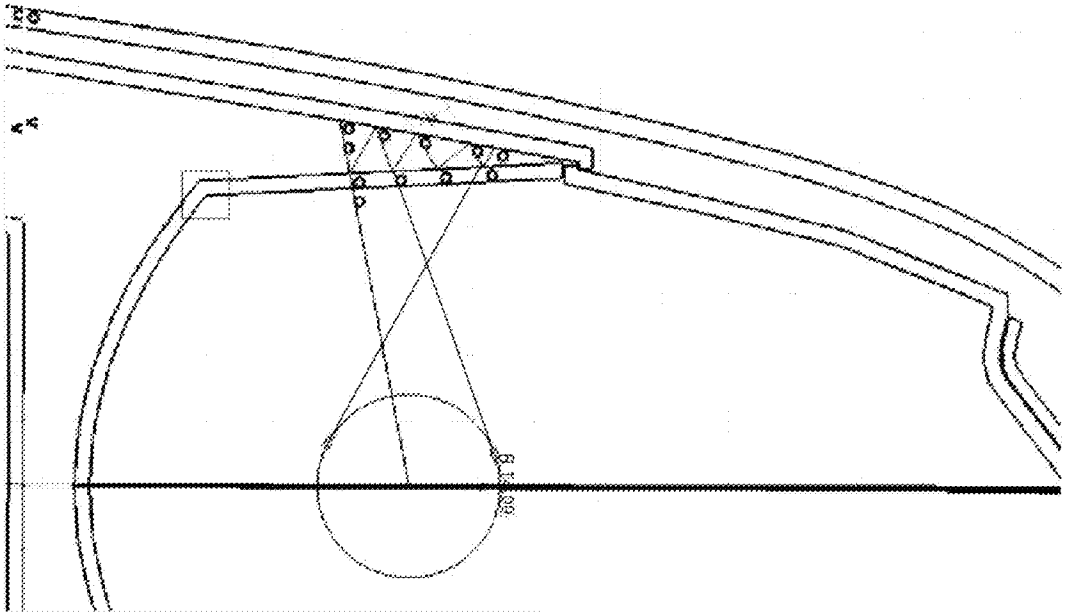
FIG. 3 illustrates a lamp device for a vehicle according to one exemplary embodiment of the present disclosure.

FIG. 2 schematically illustrates a lamp device for a vehicle according to the present disclosure, and FIG. 3 illustrates a lamp device for a vehicle according to one exemplary embodiment of the present disclosure. Hereinafter, a lamp device for a vehicle according to one exemplary embodiment of the present disclosure is described with reference to FIGS. 2 and 3.

A lamp device for a vehicle according to one exemplary embodiment of the present disclosure may include a light source 41, a lamp housing 10 on which the light source 41 may be mounted, an outer lens 21 coupled to the lamp housing 10 to allow light emitted from the light source 41 to penetrate the outer lens 21, and an inner lens 22 disposed further inside (e.g., closer to the light source 41) than the outer lens 21. The outer lens 21 may be manufactured in a color selected based on the predetermined criteria.

In addition, a complementary colored bezel 31 may be coupled to the lamp housing 10 and the inner lens 22. In particular, the complementary colored bezel 31 may be disposed further inside (e.g., closer to the light source 41) than the outer lens 21, and may be formed to have a correction color which differs from a color of the outer lens 21. The complementary colored bezel 31 may be translucent. Accordingly, the light emitted from the light source 41 may penetrate the complementary colored bezel 31 and may be changed in color according to the correction color and then reach the outer lens 21. As a result, the corrected color may be mixed with a principle color of the outer lens 21 to generate dark regions.

An aspect of the present disclosure is to improve moisture removal performance and chromaticity problem by using a color of the complementary colored bezels.

First, to improve the moisture removal performance, a light emitting region may be enlarged. When the light emitting region is enlarged, a red colored light region for tail/stop lamp may also be enlarged. Alternatively, a penetration spectrum of the red colored outer lens may be analyzed and a target penetration wavelength of the bezel may be determined to obtain a target penetration wavelength material and to select a color of the complementary colored bezel to improve the moisture removal performance without enlarging the red colored region.

Figure 4:
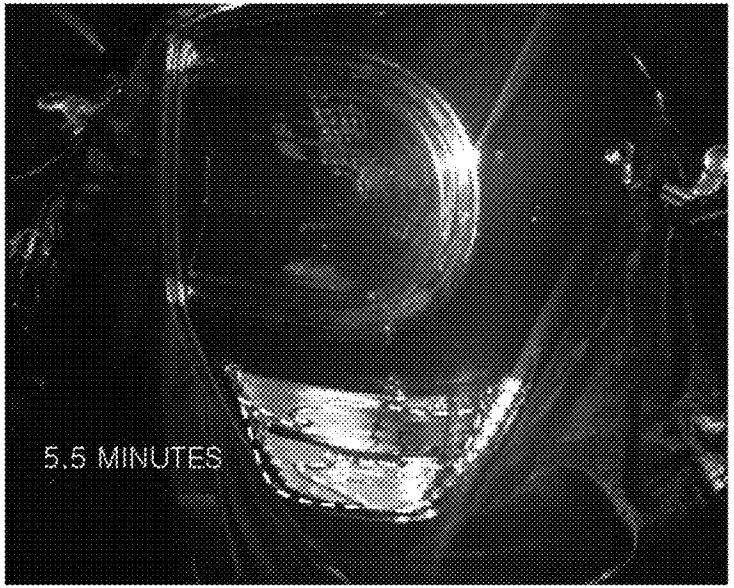
FIG. 4 shows moisture removal results obtained by a complementary colored bezel.
Figure 4:
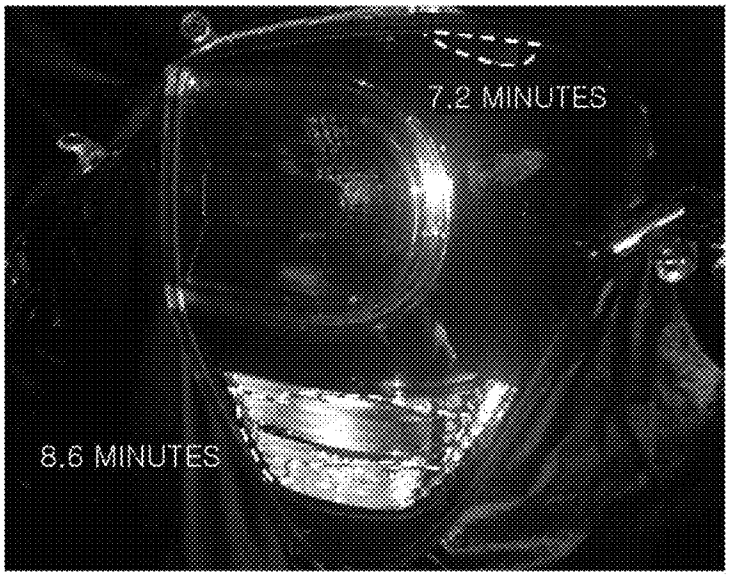

Consequently, a blue-green colored bezel through which light having a wavelength of about 580 nm or less penetrates may be specified as the complementary colored bezel in consideration of a margin width of wavelength as described later. In an experiment, when a black colored bezel was applied, 8.6 minutes were required to remove the moisture as shown on the left in FIG. 4, and when a blue-green colored bezel was applied, 5.5 minutes were required to remove the moisture as shown on the right in FIG. 4. In order to increase the margin width of the wavelength, the following cases were considered.

1) In a case where a single lens is employed, as summarized in Table 1, light having wavelength of 482 to 580 nm penetrates a green colored lens, and light having wavelength of 597 nm or more penetrates a red colored lens. Accordingly, a margin width of the wavelength is 17 nm (e.g., about 580 nm-597 nm).

TABLE 1

| | Red colored lens | Orange colored lens | Yellow colored lens | Green colored lens | Blue colored lens |
|---|---|---|---|---|---|
| Total light transmittance | 45.97% | 59.97% | 75.08% | 21.04% | 37.13% |
| Transmittable wavelength | 597 nm↑ | 550 nm↑ | 490 nm↑ | 482~580 nm | 415~490 nm<br>673 nm↑ |

The transmittable wavelength corresponds to a spectral region in which light having a total light transmittance or more penetrates, and the transmittable wavelength may be minimized through a combination of the red colored lens and the green colored lens as shown in Table 1.

Figure 5:
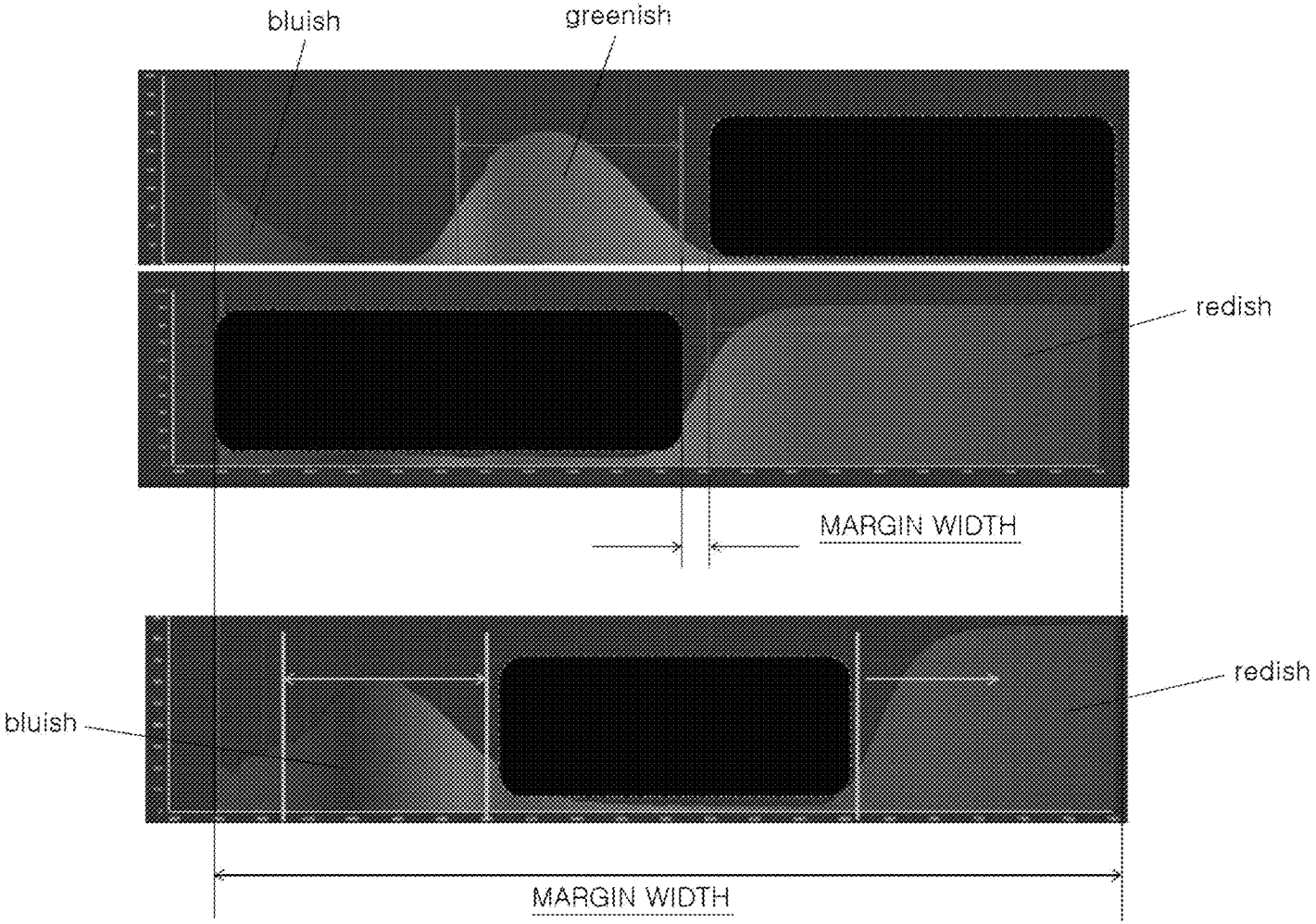
FIG. 5 shows a marginal width obtained by applying a lens.

2) In a case where two sheets of lenses are employed, as summarized in Table 2 and illustrated in FIG. 5, light having wavelength of 487 to 570 nm penetrates a green colored lens, and light having wavelength of 606 nm or more penetrates a red colored lens. Accordingly, a margin width of the wavelength is 36 nm (e.g., about 570 nm-606 nm).

TABLE 2

| | One sheet of red-colored lens | Two sheets of red-colored lenses | One sheet of green-colored lens | Two sheets of green-colored lenses |
|---|---|---|---|---|
| Total light transmittance | 45.97% | 41.23% | 21.04% | 13.60% |
| Transmittable wavelength | 597 nm↑ | 606 nm↑ | 482~580 nm | 487~570 nm |

As shown in Table 2, the margin width of the transmittable wavelength may be increased due to an increase of thickness.

3) In the case of applying a plurality of colors, as shown in FIG. 5, since light having wavelength of 482 to 580 nm penetrates a green colored lens, light having wavelength of 597 nm or more penetrates a red colored lens, and light having wavelength of 415 to 490 nm and of 673 nm or more penetrates a blue colored lens, a margin width of the wavelength is the entire range of wavelength. Therefore, by adding a blue color that prevents the light in the margin width range to penetrate, a blue-green colored bezel through which light having wavelength range equal to or less than 580 nm mainly penetrates may be determined as the complementary colored bezel.

Figure 6:
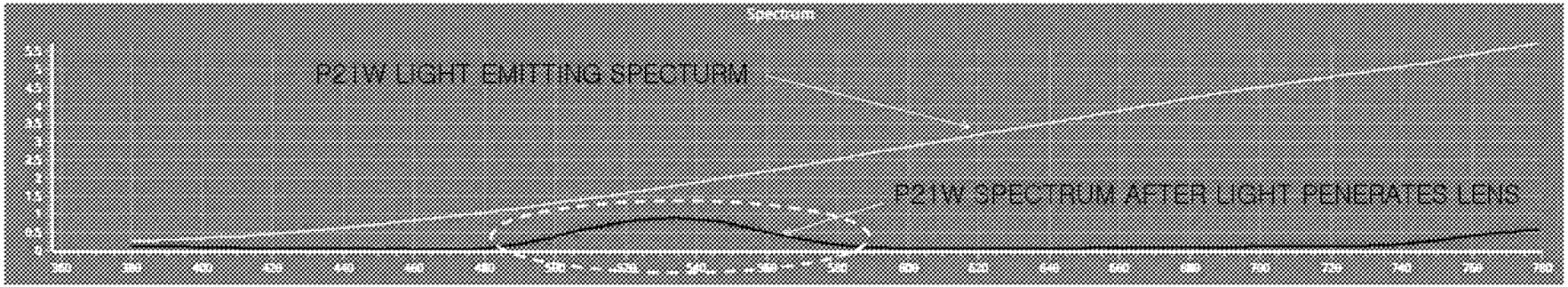
FIGS. 6 and 7 show transmission spectrums obtained by applying the lens.
Figure 7:
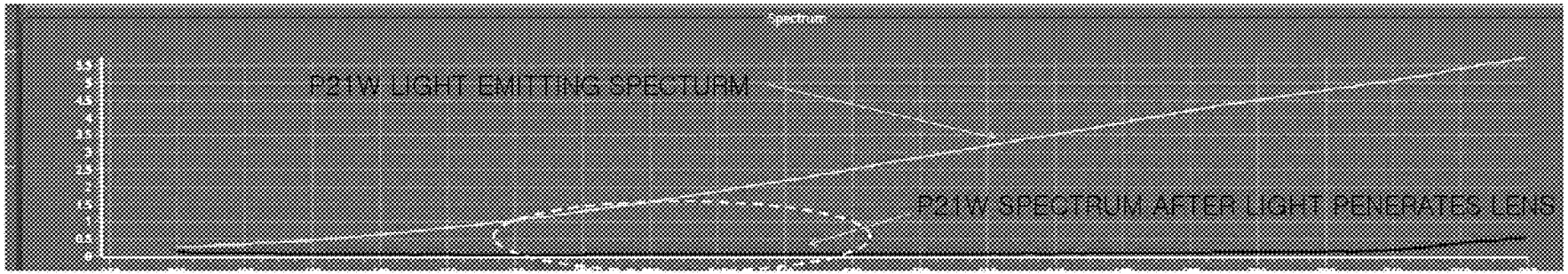

The performance of the optically transparent complementary colored bezel are shown in FIGS. 6 and 7. The penetration spectrum obtained by the green colored lens is shown in FIG. 6, and the penetration spectrum obtained by a combination of the green colored lens and the red colored lens is shown in FIG. 7. According to the measurement, the light having wavelength of about 480 to 580 nm remains as energy (e.g., thermal energy) in the red colored lens. Therefore, when a color of the bezel is changed from a black color to a blue-green color, the moisture removal performance may be improved by utilizing the remaining energy, and the esthetics may be improved over the black colored bezel.

An aspect of the present disclosure is to improve the moisture removal performance and external appearance by adjusting an irradiation direction of light that penetrates the complementary colored bezel. Accordingly, a rear surface of the complementary colored bezel of the lamp device for a vehicle according to one exemplary embodiment of the present disclosure may include a surface structure 31-1 configured to reflect irradiated light to desired directions.

In the conventional lamp device, when penetrating the complementary colored bezel, all light is directed towards the outer lens and penetrates the bezel, and the light is used for the moisture removal effect for the outer lens and a portion of filament is visible through fine pores in the bezel. Due to the surface structure 31-1 for reflecting the irradiated light, the complementary colored bezel in the present disclosure may irradiate light to a region, where moisture is frequently generated to distribute the light energy more efficiently. In particular, the surface structure formed on the rear surface of the complementary colored bezel may be processed into a rear reflector (RR) shape for reflecting the irradiated light, or may be processed into a multi focus reflector (MFR) surface.

When the rear surface of the complementary colored bezel is processed to have the rear reflector shape, the light may be reflected back toward the light source side as shown in FIG. 2, and may be reflected by a reflection plate 50 to be irradiated to the entire region of the outer lens 21 again. The above described configuration may expand the region where moisture may be removed by efficiently utilizing the light energy, and aesthetic enhancement may also be achieved. In other words, since light is reflected by the rear reflector shape, the moisture removal effect may be improved through sufficient reflection and light penetration, and the problem that the filament is visible may also be improved by reducing the energy of penetrating light simultaneously. The reflecting plate 50 may be coupled to the lamp housing 10 and may be disposed behind the light source 41.

Figure 8:
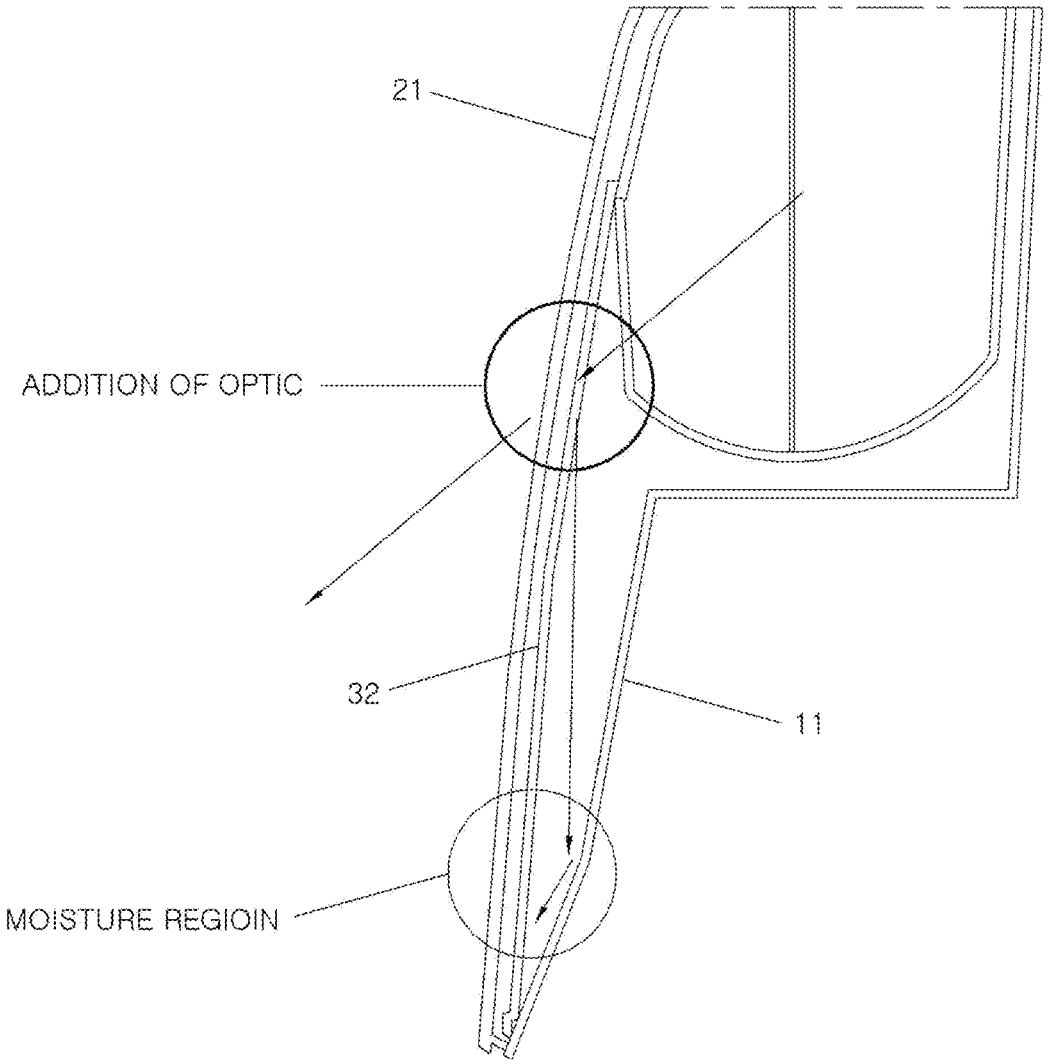
FIGS. 8 and 9 illustrate a lamp device for a vehicle according to another exemplary embodiment of the present disclosure.
Figure 9:
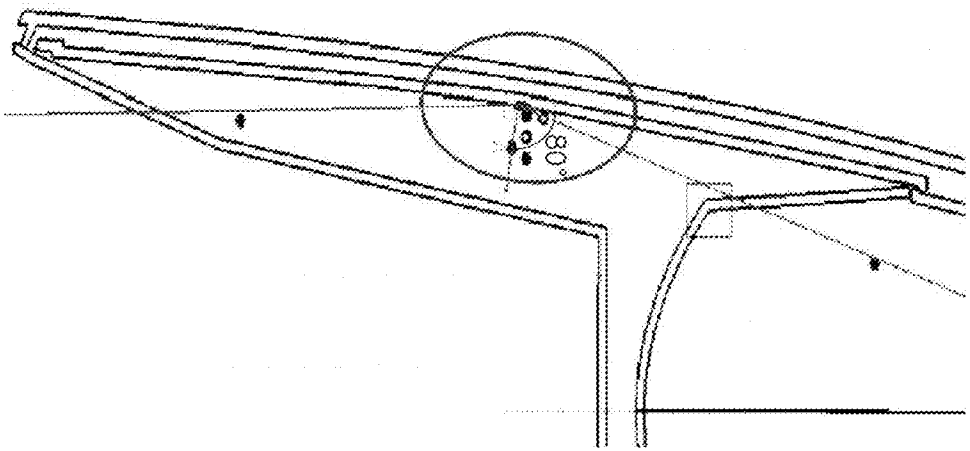

FIGS. 8 and 9 illustrate a lamp device for a vehicle according to another exemplary embodiment of the present disclosure, and show an irradiating path of light when the surface structure configured for reflecting light to the complementary colored bezel is finely (e.g., smoothly) and optically processed. Light directed towards the bezel 32 may be repeatedly reflected between the bezel 32 and a lamp housing 11 by the above Multi Focus Reflector (MFR) reflecting surface to be transmitted to the moisture region to irradiate the moisture region with light energy. Thus, the moisture removal effect may be increased and improved.

In addition, when the complementary colored bezel 32 is embodied as a rear combination bezel injected in a blue-green color, since the bezel may reduce the amount of light that exits the outer lens 21 and blue-green colored light does not penetrate the red colored outer lens 21, an outer surface of the bezel may appear to be a black colored bezel to maintain the aesthetic design. In other words, by irradiating the reflected light having a reflection angle which is equal to an incident angle of incident light with respect to a normal line, light may be directed to a region where moisture is likely to be generated. By this configuration, the moisture removal effect may be improved, and the light may be irradiated to a desired region by the surface structure, thereby increasing the moisture removal effect and improving the problem that the filament is visible. In addition, since a penetration of a part of light may occur more easily than in the case of deposition or addition of a separate reflection surface, this configuration may generally enhance a uniform moisture removal.

Figure 10:
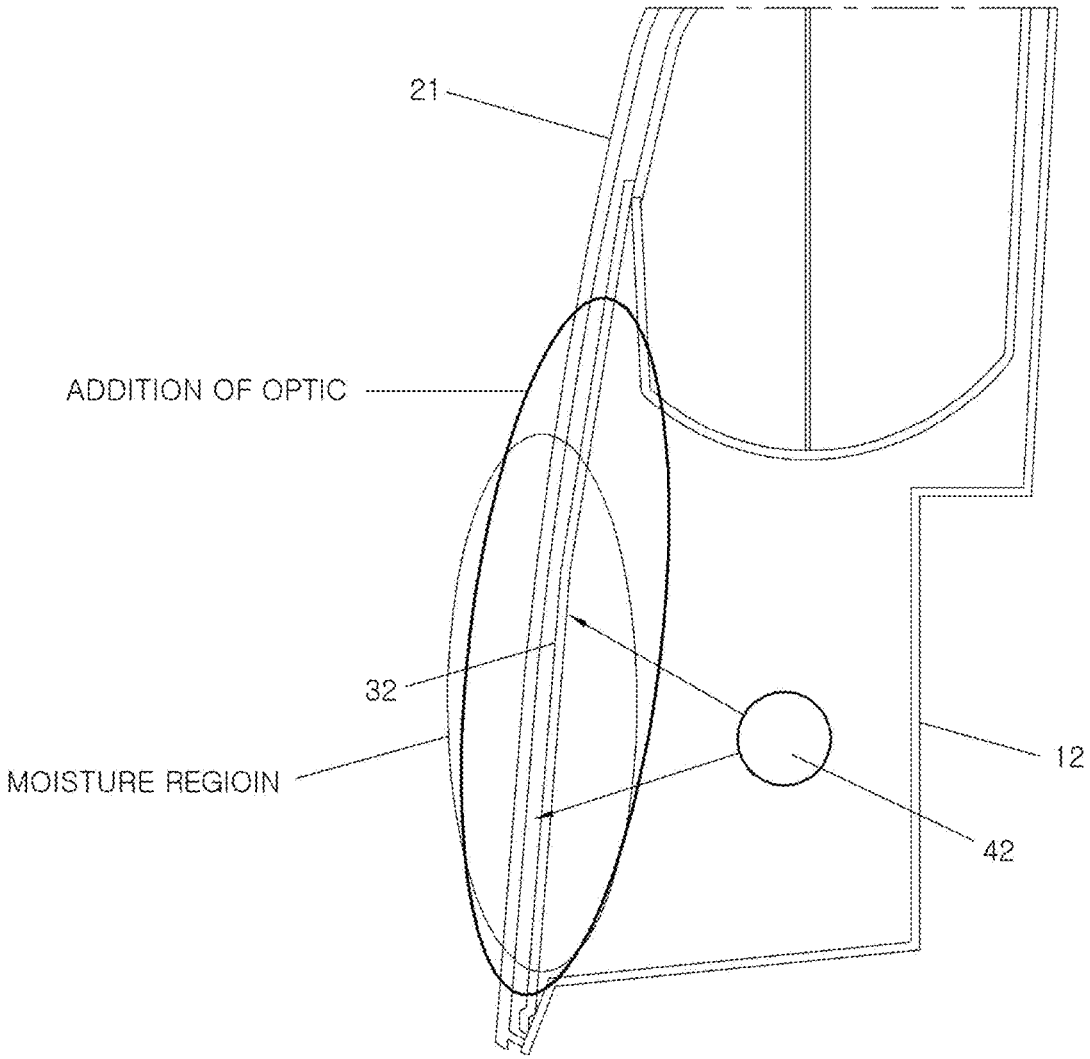
FIG. 10 illustrates a lamp device for a vehicle according to still another exemplary embodiment of the present disclosure.

FIG. 10 is a view illustrating a lamp device for a vehicle according to still another exemplary embodiment of the present disclosure. The exemplary embodiment illustrated in FIG. 10 may include an additional light source 42 between the bezel 32 and a housing 12. As shown in FIG. 10, due to the additional light source 42, the moisture removal performance may be improved. In addition, when the complementary colored bezel 32 is embodied as a rear combination bezel injected in a blue-green color, an outer surface of this bezel may appear as an outer surface of a black colored bezel, and thus the aesthetic design may be maintained. In addition, the problem that the filament is visible may also be improved.

According to the lamp device for a vehicle of the present disclosure, a light that penetrates the outer lens may be adjusted by utilizing the property of incident light to be reflected at a particular angle, thereby improving filament light leakage. In addition, the moisture region may be irradiated with the light using the property that an incident angle is equal to a reflection angle, the moisture removal performance may be enhanced.

Although the above-described present disclosure has been described with reference to the illustrated drawings, it will be apparent to those skilled in the art that various changes and modifications can be made without departing from the scope of the present disclosure. Accordingly, such modifications or changes should be considered as being fallen with the claims of the present disclosure, and the scope of the present disclosure should be construed on the basis of the appended claims.

What is claimed is:

1. A lamp device for a vehicle, comprising:

a light source;

a lamp housing that accommodates the light source thereon;

a lens coupled to the lamp housing to allow light emitted from the light source to penetrate the lens; and a bezel coupled to the lamp housing and disposed between the lens and the light source, wherein a distance between a center of mass of the bezel and a center of mass of the light source is shorter than a distance between the center of mass of the light source and a center of mass of the lens, wherein the lens includes a first color and the bezel includes a second color that is complimentary to the first color, wherein the second color is blue-green, wherein the light emitted from the light source penetrates the bezel and is changed in color according to a correction color of the bezel and reaches the lens, and wherein the correction color is mixed with the first color of the lens to generate dark regions on the lens; wherein the rear surface of the bezel is formed to have a multi focus reflector (MFR) surface configured to reflect the light emitted from the light source at a reflection angle equal to an incident angle, and wherein the light directed toward the bezel is repeatedly reflected between the bezel and the lamp housing by the multi focus reflector (MFR) surface.

2. The lamp device for the vehicle of claim 1, wherein the first color is red.

3. The lamp device for the vehicle of claim 2, wherein the lens transmits light having wave lengths equal to or greater than about 597 nm.

4. The lamp device for the vehicle of claim 1, wherein the bezel transmits light having wave lengths equal to or less than 540 nm.

5. The lamp device for the vehicle of claim 1, wherein the rear surface of the bezel is formed to have a rear reflector (RR) shape by which the light emitted from the light source is substantially reflected rearward.

* * * * *